United States Patent [19]

Illig et al.

[11] Patent Number: 4,591,140

[45] Date of Patent: May 27, 1986

[54] ARRANGEMENT FOR SEPARATING AND TRANSPORTING UPPERMOST SHEETS OF A STACK OF SHEETS OR SHEET-LIKE OBJECTS

[75] Inventors: Egon Illig, Stuttgart; Josef Gentischer, Weinstadt; Wolfgang Schmutz, Rottweil, all of Fed. Rep. of Germany

[73] Assignee: Agfa-Gevaert Aktiengesellschaft, Leverkusen, Fed. Rep. of Germany

[21] Appl. No.: 588,131

[22] Filed: Mar. 8, 1984

[30] Foreign Application Priority Data

Mar. 12, 1983 [DE] Fed. Rep. of Germany ..... 3308867
Feb. 7, 1984 [DE] Fed. Rep. of Germany ..... 3404215

[51] Int. Cl.[4] ..... B65H 5/10

[52] U.S. Cl. ..... 271/11; 271/31.1; 271/93; 271/107; 271/146; 271/194

[58] Field of Search ..... 271/11, 90, 91, 93, 271/107, 146, 194, 31.1

[56] References Cited

U.S. PATENT DOCUMENTS 3,764,133 10/1973 Gray ..... 271/107 X
3,994,488 11/1976 Takenaka ..... 271/98
4,351,518 9/1982 Stievenart ..... 271/90

FOREIGN PATENT DOCUMENTS 534081 9/1931 Fed. Rep. of Germany ..... 271/90
1782267 12/1958 Fed. Rep. of Germany .

*Primary Examiner*—Richard A. Schacher
*Attorney, Agent, or Firm*—Michael J. Striker

[57] ABSTRACT

An arrangement for separating and transporting uppermost sheets of a stack of sheets or sheet-like objects has a movable suction mouthpiece in which negative pressure acting for adhering the sheet simultaneously controls the movement of the suction mouthpiece in a longitudinal direction in a guide, the movable suction mouthpiece is connected with a valveless pump which produces in a connecting conduit between the suction mouthpiece and the pump periodically alternating negative pressure and positive pressure phases, and the guide of the movable suction piece is arranged so that a movement direction provided by the guide is inclined relative to the direction of the force of gravity at such an angle that the resultant of a lifting movement of the sheet produced during the lower pressure phase of the movable suction mouthpiece and the falling movement produced during the positive pressure phase has a component acting in a desired transporting direction of the sheet.

18 Claims, 16 Drawing Figures

ARRANGEMENT FOR SEPARATING AND TRANSPORTING UPPERMOST SHEETS OF A STACK OF SHEETS OR SHEET-LIKE OBJECTS

BACKGROUND OF THE INVENTION

The present invention relates to an arrangement for separating and transporting uppermost sheets of a stack of sheets or sheet-like objects with the aid of a movable suction mouthpiece, which has a negative pressure acting for adhering the sheets which simultaneously controls the movement of the suction mouthpiece longitudinally displaceably supported in a guide.

Arrangements of the above mentioned general type are known in the art. One such arrangement is disclosed, for example, in the DE-GM 1,782,267. To obtain a transport movement in the direction to the subsequent transporting rollers, a blowing nozzle is required whose air stream can engage several upper sheets of the stack and thereby can distort the separating process.

SUMMARY OF THE INVENTION

Accordingly, it is an object of the present invention to provide an arrangement for separating and transporting uppermost sheets of a stack of sheets or sheet-like objects, which avoids the disadvantages of the prior art.

More particularly, it is an object of the present invention to provide an arrangement for separating and transporting uppermost sheets of a stack of sheets or sheet-like objects, in which the reliability of the separating process is increased and the movable suction mouthpiece can perform in a simple manner not only the separation, but also the transportation of the sheets to the subsequent transporting rollers.

In keeping with these objects and with others which will become apparent hereinafter, one feature of the present invention resides, briefly stated, in an arrangement for separating and transporting of upper sheets of a stack of sheets or sheet-like objects in which the movable suction mouthpiece is connected with a valveless pump generating in a connecting conduit between the suction mouthpiece and the pump periodically alternating positive pressure and negative pressure phases, and a guide of the movable suction mouthpiece provides for the movement direction inclined at such an angle relative to the direction of the force of gravity that the resultant of a lifting movement of the sheet during the negative pressure phase of the movable suction mouthpiece and a falling movement produced during the positive pressure phase has a component directed into a desired transporting direction of the sheet.

When the arrangement is designed in accordance with the present invention, the movable suction mouthpiece first performs a lifting movement, which lifts a sheet to be separated from the stack. This lifting movement is joined with a pulsating movement of the suction mouthpiece, which, on the one hand, shakes off double sheets unintentionally pulled by the suction mouthpiece and, on the other hand, provides the transportation of the sheets to the subsequent transporting rollers by the periodic alternation of the lifting and falling movements of the sheet performed in predetermined directions. The pulsating movement of the suction mouthpiece can be amplified when the engaging surface of the air pressure acting in the connecting conduit between the suction mouthpiece and the valveless pump and periodically alternating, is increased by a diaphragm connected with the mouthpiece.

For bridging great stack heights, an additional adjusting device with a separate drive for the movable suction piece or a level-regulating lifting table for the stack can be provided.

In accordance with the embodiment which is especially reliable for the separation, the stack stable is inclined opposite to the transporting direction and provided with a rear stack stop. In this manner, very thin air-permeable sheets, as well as synthetic plastic foils adhering to one another because of electrostatic charges, can be uniformly and reliably separated.

The transporting speed in direction of the subsequent transporting rollers can be increased by the use of a stack table inclined in the transporting direction and provided with front stack stops. This embodiment is favorable also for post-displacement of the sheets during the operation.

In all embodiments of the inventive separating and transporting arrangement, it is possible to place the transported sheet on a stationary transporting roller pair working in a known manner cyclically in dependence upon the working phases of the sequential apparatus, or until a lateral stack stop, without significant friction forces on the movable suction mouthpiece and the transported sheet, or without wear phenomena caused by friction.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
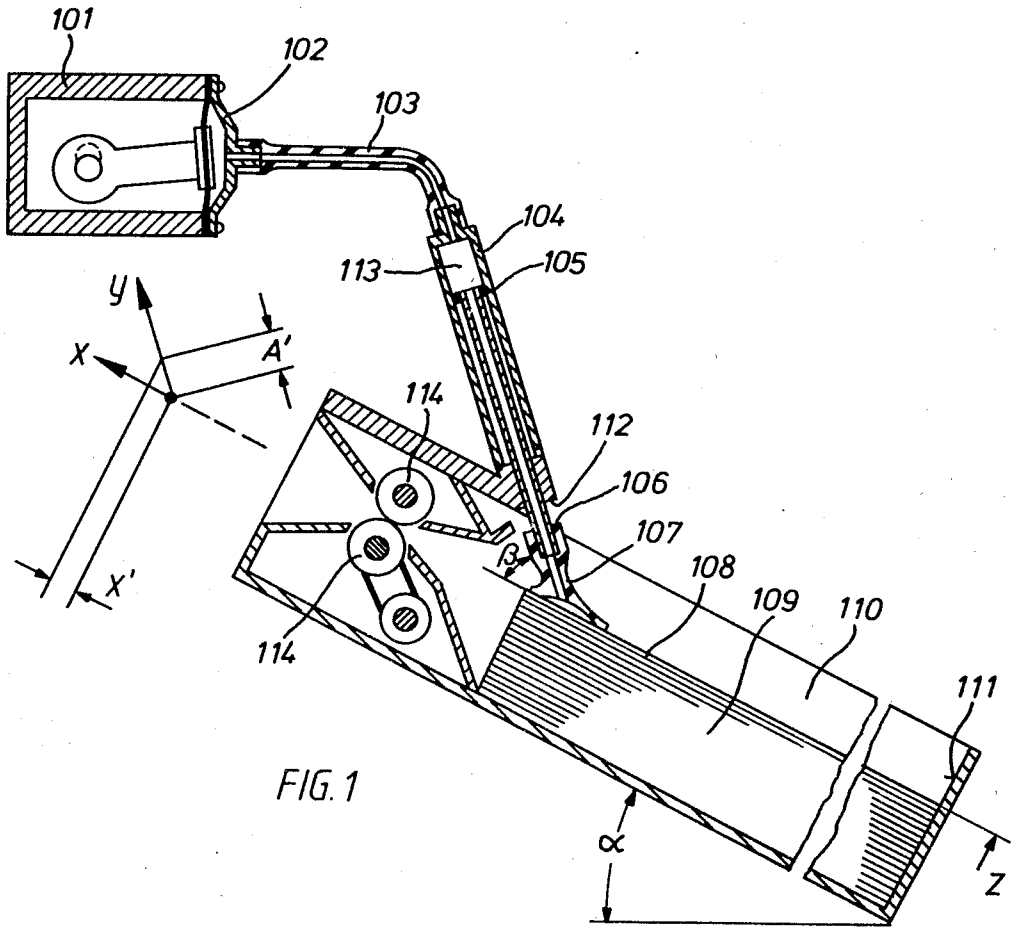
FIG. 1 is a view showing a section of an arrangement for separating and transporting an uppermost sheet of a stack of sheets or sheet-like objects, in accordance with one embodiment of the invention.

In accordance with one example shown in FIG. 1, a cover 102 is provided with only one connection and has no valve. This solution is technically simpler and less expensive.

Figure 2:
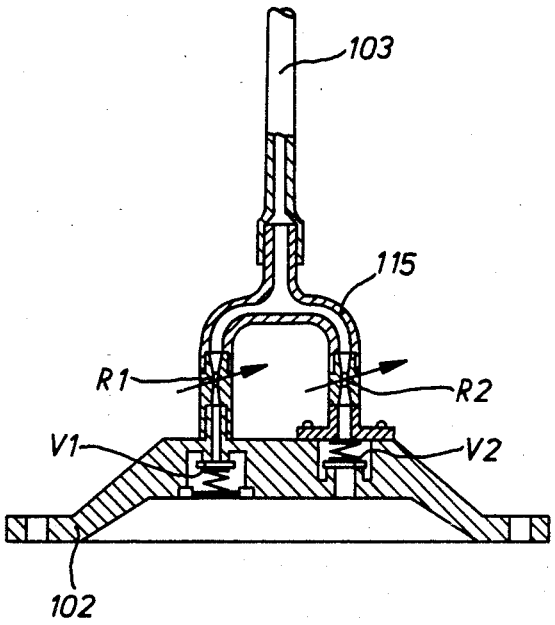
FIG. 2 is a view showing a section substantially corresponding to the section of FIG. 1, but illustrating another embodiment of the present invention.

In accordance with a second example in which a pump cover is used with two check valves V1 and V2 and flow resistors R1 and R2 for suction conduit and pressure conduit, there is a possibility to differently adjust the phase length. Both connections of the pump cover can be united via a T-piece. This example is shown in FIG. 2.

The operation of the arrangement in accordance with the present invention is as follows:

A supply container 110 is arranged so that it is somewhat inclined downwardly and filled with a paper stack lying on a rear stop face up to the height z. A pulse suction member located above it is arranged in the center of sheets in the vicinity of the sheet front edge so that its longitudinal axis is inclined at an angle $\beta < 90°$ to the upper surface of the stack.

Figure 3:
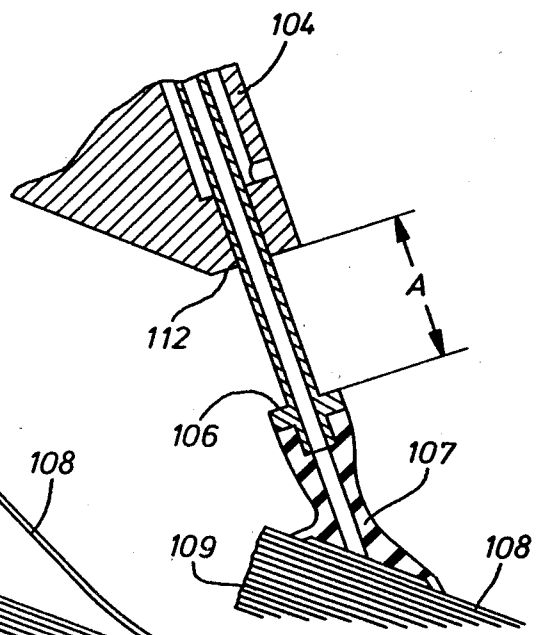
FIGS. 3–9 are views showing various operational stages of the inventive arrangement in accordance with FIGS. 1 and 2.
Figure 4:
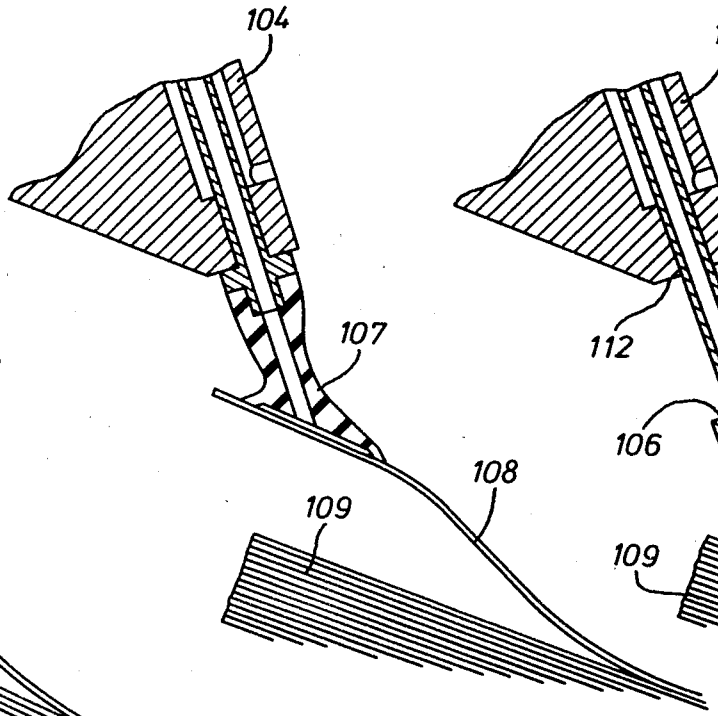
Figure 5:
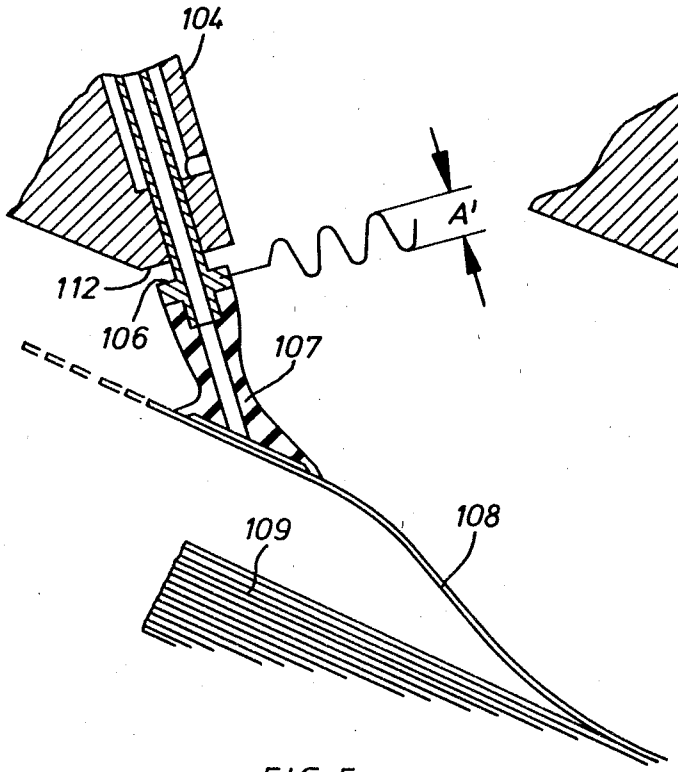
Figure 6:
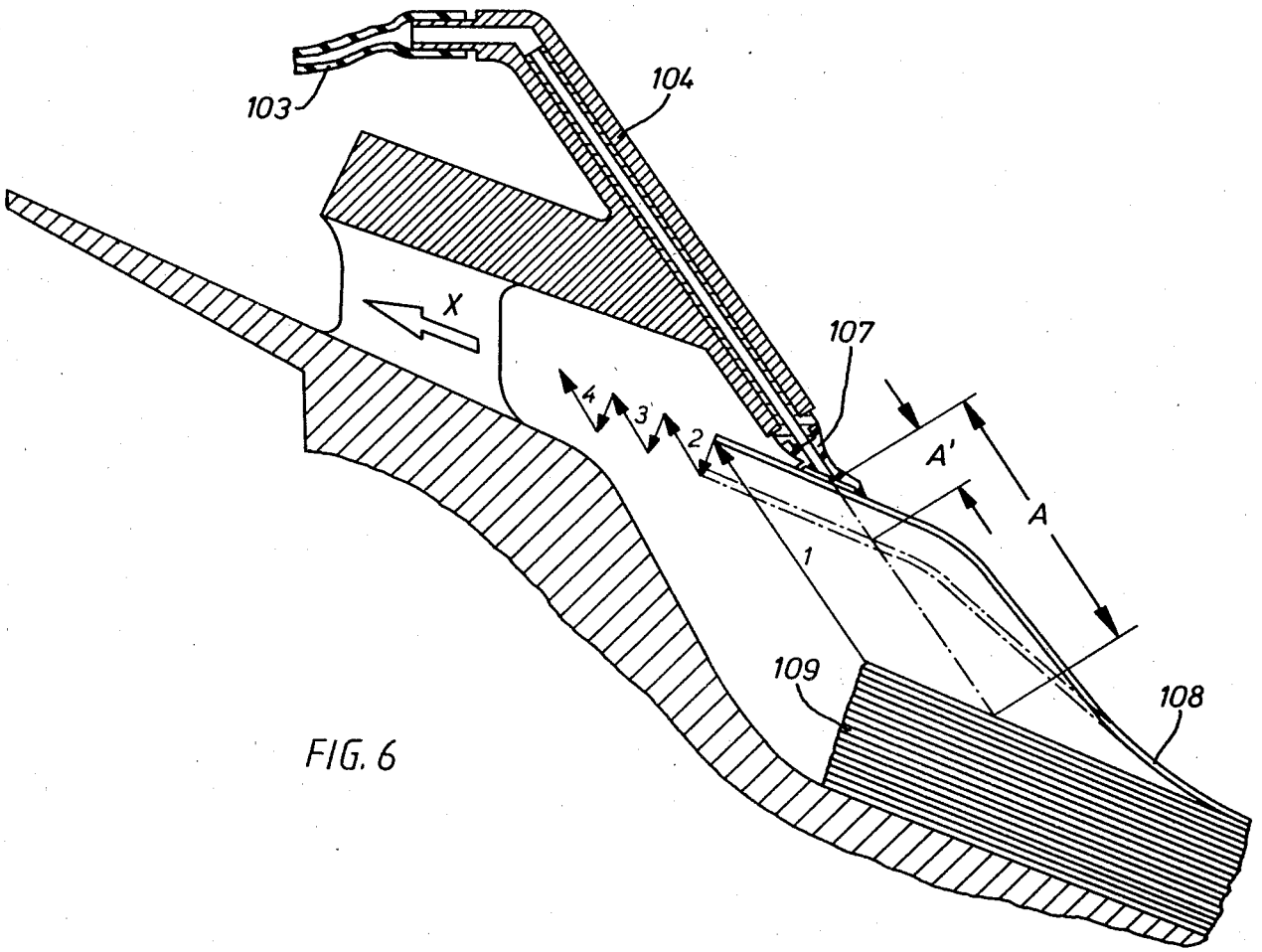
Figure 7:
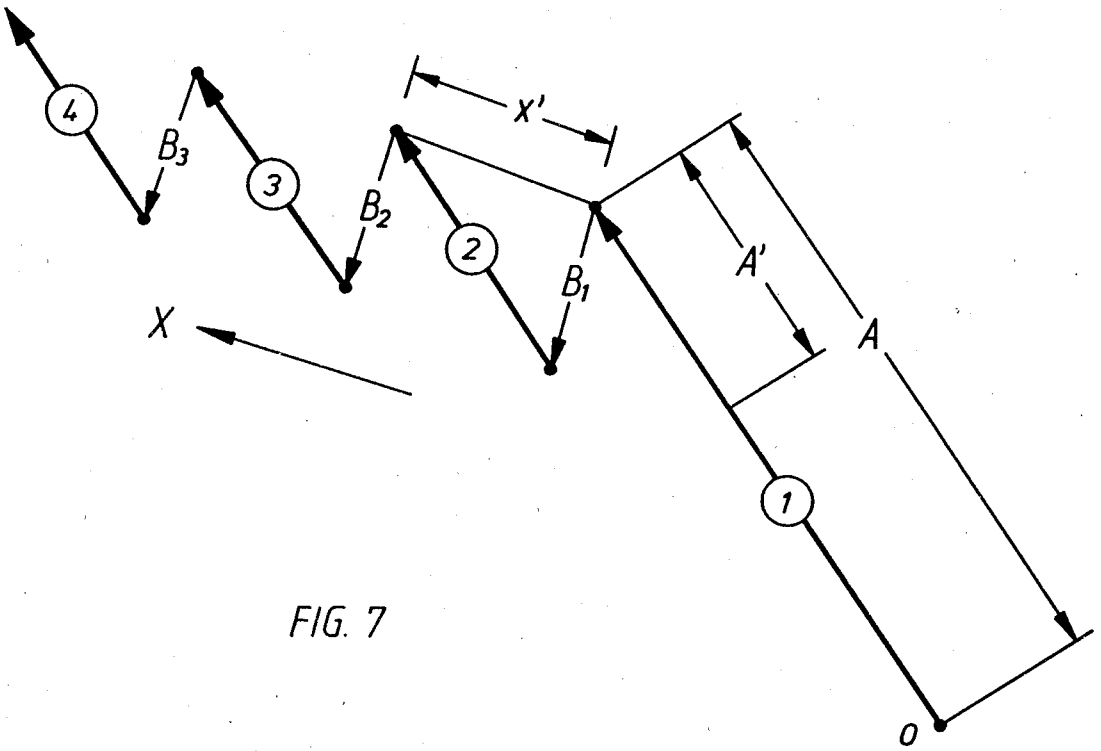
Figure 8:
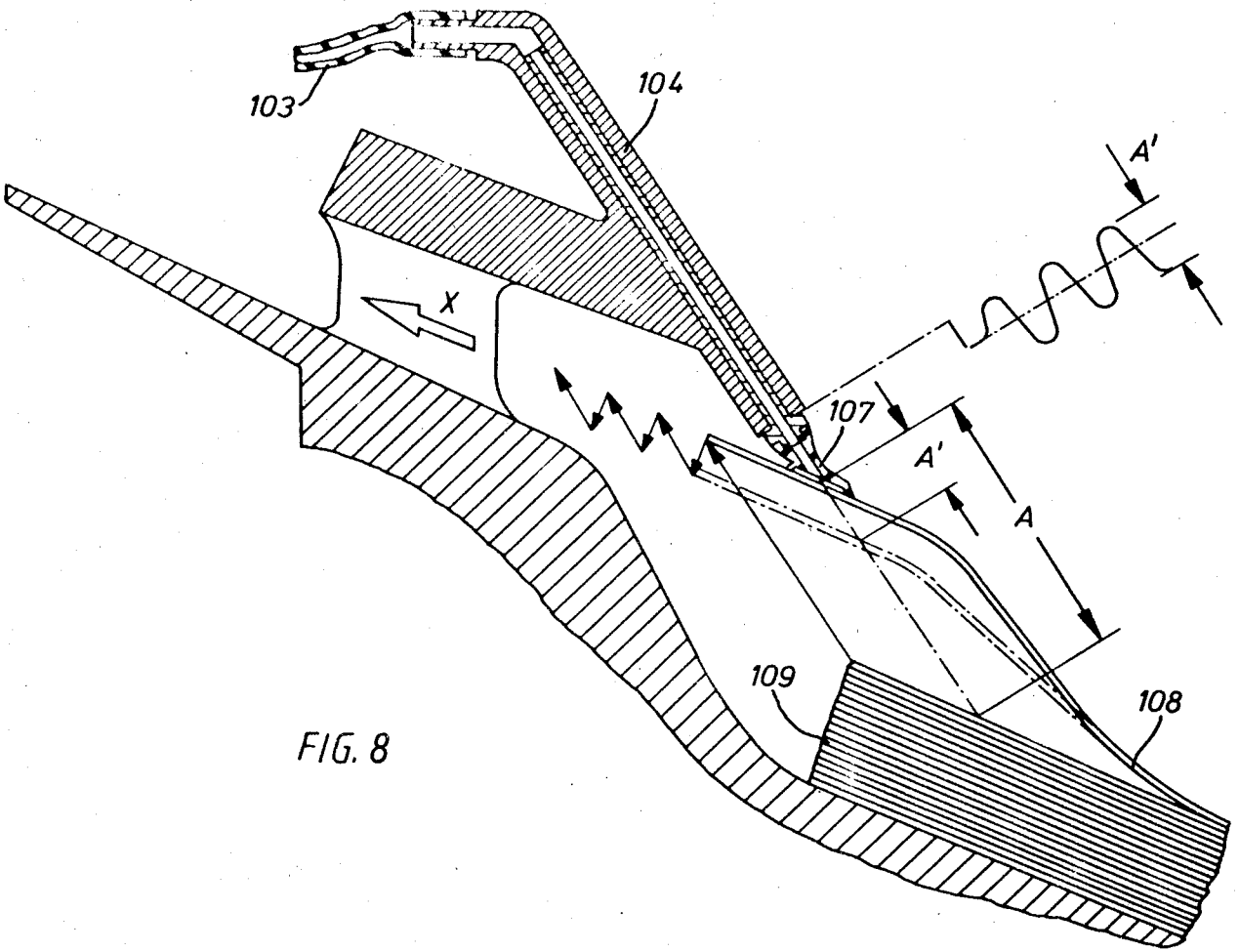
Figure 9:
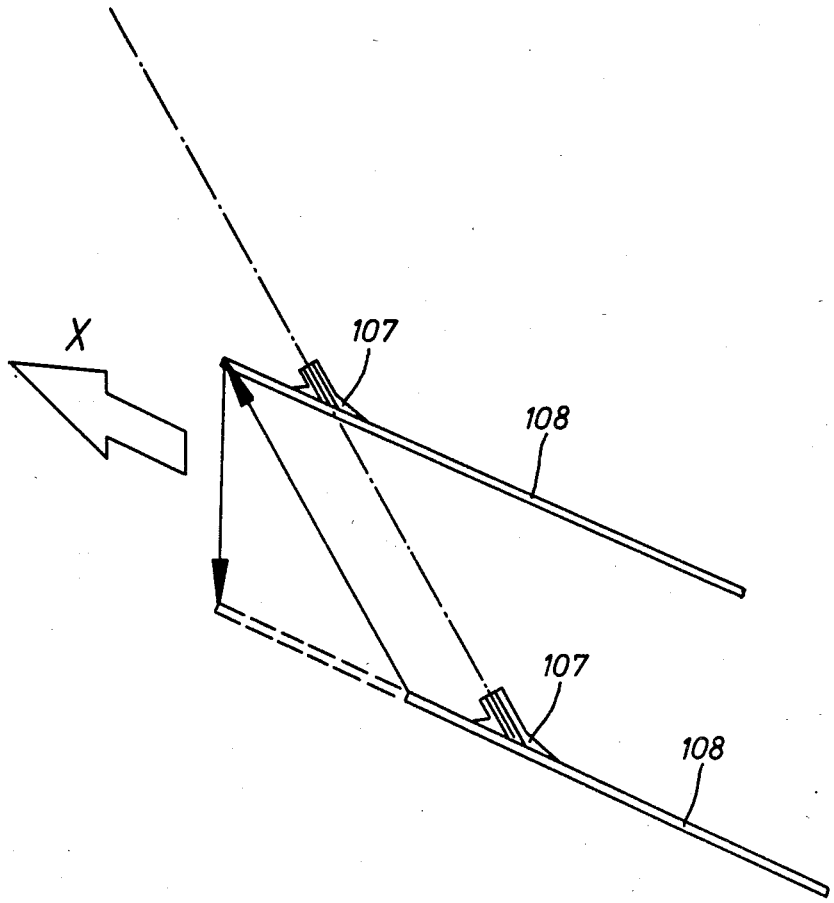

In inoperative position, with a turned-off pump, a suction rubber mounted at the lower end of the pulse suction piston lies with its suction surface on the uppermost sheet of the paper stack plainly, as can be seen from FIG. 3. After turning on of the diaphragm pump, an alternating positive and negative pressure is produced in the suction-/pressure chamber synchronously with the pump frequency, and it propagates through the suction rubber to the uppermost sheet. During the first suction phase, the pulse suction piston is lifted with the uppermost sheet until it contacts with a stop 106 a stop surface 112, as shown in FIG. 2. The pulse suction piston thereby performs a stroke A.

This part of the working process forms a separating step. The separated sheet can now be transferred to another arrangement and transported further. This is, however, not necessary, since during the subsequent negative-/positive pressure phases the pulse suction piston tightly pulsates under its upper stop with the amplitude A'. The sheet which hangs on the suction rubber is thereby shortly released during the positive pressure phase and then again pulled during the subsequent suction phase.

As can be seen from the vector diagram shown in FIGS. 6–9, the separated sheet obtains a forward drive in direction X until it abuts against a sheet roller pair 114 shown in FIG. 1.

Then the paper sheet can be pulled under the suction member 107 at a predetermined later time point, without turning off of the pulse suction member or the pump.

Figure 10:
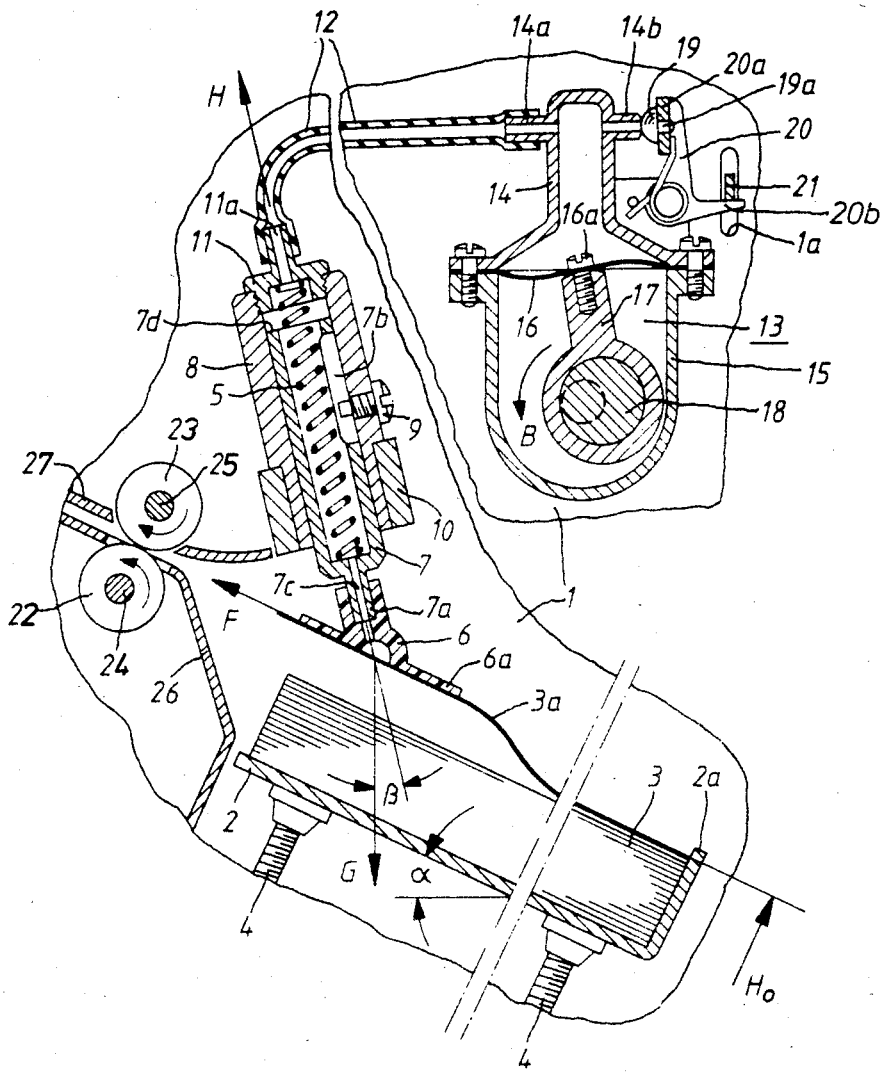
FIG. 10 is a view showing which semi-schematically shows the inventive arrangement in accordance with a further embodiment of the invention.

FIG. 10 shows an arrangement in which a stack table 2 for a sheet stack 3 is arranged in a frame 1. The stack table 2 is inclined at an angle $\alpha$ relative to a horizontal plane and has at its rear end a stack stop 2*a*. A sheet 3*a* located on the stack abuts against the stack stop 2*a* under the action of the gravity force. It is formed as a so-called rising table which can be adjusted in a known manner in a direction normal to the upper surface of the stack with the aid of threaded spindles 4, under the action of a not shown stack sensor, so that the upper surface of the stack always assumes a level identified in the drawing by a line $H_o$.

The uppermost sheet 3*a* of the stack 3 lies under the action of its own weight and a light pressing spring 5 against a movable suction mouthpiece 6. The mouthpiece 6 is fitted on a mouthpiece 7*a* formed at the lower end of a movable piston 7. The mouthpiece 7*a* has a central opening 7*c*. The piston 7 is supported in a longitudinally movable manner in a guide cylinder 8, and a stop screw 9 is screwed into an opening 7*b* of the piston 7 to engage the latter. The guide cylinder 8 is inserted in a holder 10 which is fixedly connected with the arrangement, and is provided at its upper end with a locking piece 11 having a central opening 11*a*. The locking piece 11 is screwed into the guide cylinder 8 and serves simultaneously as a countersupport for a pressing spring 5 located in the interior of the piston 7.

A connecting conduit 12 is inserted in the locking piece 11 and communicates the interior of the guide cylinder 8 with a valveless diaphragm pump 13. A diaphragm 16 of the diaphragm pump 13 is clamped between an upper part 14 and a lower part 15 and connected by a screw 16*a* with a connecting rod 17. The connecting rod 17 is driven in a periodic movement by an eccentric 18 which is supported in the lower part 15 of the diaphragm pump and driven by a not shown drive motor in direction of the arrow B. It is to be understood that, instead of the diaphragm pump shown in the drawing, also a valveless piston pump or other pumps suitable for generation of periodically alternating positive and negative pressure can be used.

The upper part 15 carries, in addition to a tubular connecting piece 14*a* for the connecting conduit 12, also a tubular piece 14*b* which serves as a ventilating conduit and is closable by a semispherical valve body 19 composed of an elastic material. A pin-shaped projection 19*a* of the valve body 19 is inserted in a corresponding opening of a vertical tongue 28 of a two-arm tilting lever 20. The tilting lever 20 is arranged under the action of a leg spring 21 which tends to turn it in a counterclockwise direction so that the valve body 19 abuts against the opening of the tubular piece 14*b*. One arm 20*b* of the tilting lever 20 cooperates with an actuating lever 21 which extends through an opening 1*a* of the frame 1. The actuating lever 21 is controlled by a not shown, for example electromagnetic, element of a control device of an apparatus arranged subsequently to the inventive arrangement, in accordance with a cycle in which the separation of the sheets takes place. Opening of the valves 14*b* and 19 provides for the respective interruption of the separation and transportation steps.

Finally, transport rollers 22 and 23 are arranged behind the stack table 2, as considered in a transporting direction F of the separated sheets. The rollers 22 and 23 are supported on shafts 24 and 25. The transporting rollers 22 and 23 can either continuously rotate in the direction shown by the arrow, or be driven intermittently in accordance with a cycle required by the subsequent processing machine. With the latter mentioned cycling, for example in the case of a copying apparatus, accurate placement of the copy carrier on the recording cylinder is controlled. The transporting rollers 22 and 23 are surrounded by guiding sheets 26 and 27 for the transported paper sheets.

Figure 11:
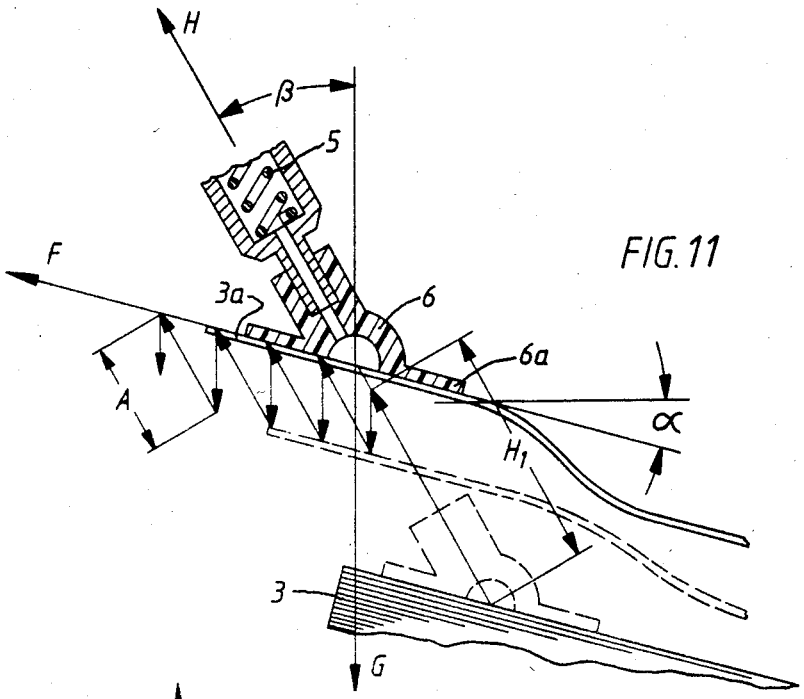
FIG. 11 is a view showing a movement diagram of a sheet engaged by a suction mouthpiece of the inventive arrangement.
Figure 12:
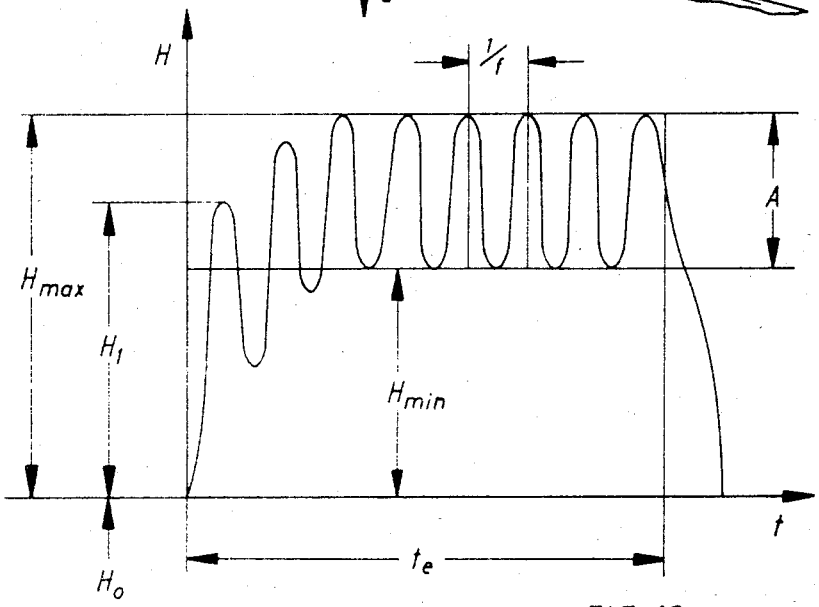
FIG. 12 is a view illustrating a time diagram of the movement of the suction mouthpiece.

FIGS. 11 and 12 show a movement process of the suction mouthpiece 6 and the sheet 3*a* engaged by it. The movable suction mouthpiece 6 lies first under the action of the pressing spring 5 against the uppermost sheet of the stack 3. After closing of the ventilating valve 19 shown in FIG. 10, or when no ventilating valve is provided after starting of the pump 13, the sheet 3*a* is pulled to the suction mouthpiece, and it closes, similar to a check valve the opening 7c of the piston 7. A negative pressure is generated in the interior of the guide cylinder 8 and acts on the rear stop surface of the piston cross section 7d shown in FIG. 10. Thereby the piston 7 is lifted against the action of its own weight and the force of the pressing spring 5, starting from the stack level $H_o$, by a stroke $H_1$ corresponding to the volume ratio of the guiding cylinder 8 and the diaphragm pump 13.

During the following positive pressure phase of the diaphragm pump 13, the piston 7 cannot follow the pump movement inertia-free, whereby the volume difference between the pump stroke and the piston stroke takes place which intermittently generates a positive pressure in the connecting conduit 12 which is under a negative pressure because of the inherent weight of the piston and the action of the pressing spring 5. This leads to blowing of air through a check valve which is formed by the sheet 3a and the movable suction mouthpiece 6 and acts in connection with the inertia of the movable suction mouthpiece. During the subsequent stroke of the diaphragm pump 13, the piston 7 no more arrives to its stack-side end position, on the one hand, and is no more lifted over the entire stroke $H_1$ corresponding to the volume ratio of the pump 13 and the guide cylinder 6. Moreover, after a short transitional time, a periodic piston movement takes place with the amplitude A which remains substantially equal during the entire switching-on time $t_e$. This amplitude reciprocates the suction mouthpiece 6 with a frequency corresponding to the pump frequency f between the stroke height $H_{min}$ and $H_{max}$. The amplitude A or the value of the $H_{max}$ and $H_{min}$ depends particularly from the following factors whose respective selection influences the same in a desired sense:

volume ratio of the pump, the cylinder guide and the air conduits provided therebetween, inertia of the movable suction mouthpiece, as well as the type and strength of the return force acting thereon, for example pressing spring 5, the pump frequency, and the relative influence of the negative pressure acting on the suction mouthpiece upon the adherence of the sheets and lifting of the piston.

Movement characteristics suitable for the removal of papers sheets of various surface weights and of thin synthetic plastic foils are obtained with the conventional dimensioning in known telescoping suction members, with the utilization of a lighter pressing spring with flatter characteristics and with a stroke height $H_{max}$ of substantially between 10 and 20 mm and a pump frequency of substantially between 20 and 30 Hz.

It has been found that both the suction and the separation reliability of the inventive separating and transporting arrangement can be improved with the use of a suction mouthpiece which is provided with a maximum elastic suction plate 6a shown in the drawing for example in FIGS. 10, 11, 15 and 16. The suction plate 6a closes because of its elasticity the uppermost sheet of the stack in the case of unevenness and angular differences in a tight manner and provides a great surface for the engaging negative pressure. In the cases when between the suction plate 6a and the uppermost sheet of the stack first a small distance remains, the air flowing under the expanded suction plate with a relatively great speed provides a negative pressure which in most cases is sufficient for performing the suction step.

The relative effect of the air pressure acting in the connecting conduit 12 on the lifting movement of the suction mouthpiece 6 allows to arrive in the air path, as will be explained hereinbelow, by an increase of the active piston surface 7d or by the switching-on of a diaphragm connected with the piston 7.

As can be particularly seen from FIG. 11, the above described movement characteristic of the movable suction member 6 leads to the fact that the uppermost sheet 3a of the stack 3 is first lifted from the stack by the stroke $H_1$. After this, it performs falling movements in the direction of the force of gravity G and lifting movements in the movement direction H of the movable suction mouthpiece 6 in a rhythm of the pump frequency and in alternating order. With inclination of the suction guide by a suitable angle $\beta$ relative to the direction of the force of gravity G, a resulting movement in the transporting direction F is produced from both above described movements.

In the examples shown in FIGS. 10 and 11, the transporting direction F is inclined by an angle $\alpha$ relative to the horizontal plane. This inclination of the transporting direction F, which substantially corresponds both to the inclination of the lower surface of the suction mouthpiece and the inclination of the upper surface of the stack, contributes to the retention of the sheet in the stack under the action of the force of gravity and thereby increases the separation reliability of the separating arrangement.

A special advantage of the inventive separating arrangement is that the transported sheet during its above described lifting and falling movements cooperates with the suction mouthpiece 6 without a friction connection. It is therefore possible to move or fix the separated sheet without turning-off of the pump under the action of additional forces practically in a friction-free manner against the movement direction provided by the suction mouthpiece. This is of importance for often practical placement of the separated sheets against a stationary suction roller pair, on the one hand. On the other hand, it is also possible, as can be seen in FIG. 13, to transport sheets of different formats with the aid of only one suction member placed in a suitable manner, and to place them during the transport step onto a lateral guide.

Figure 13:
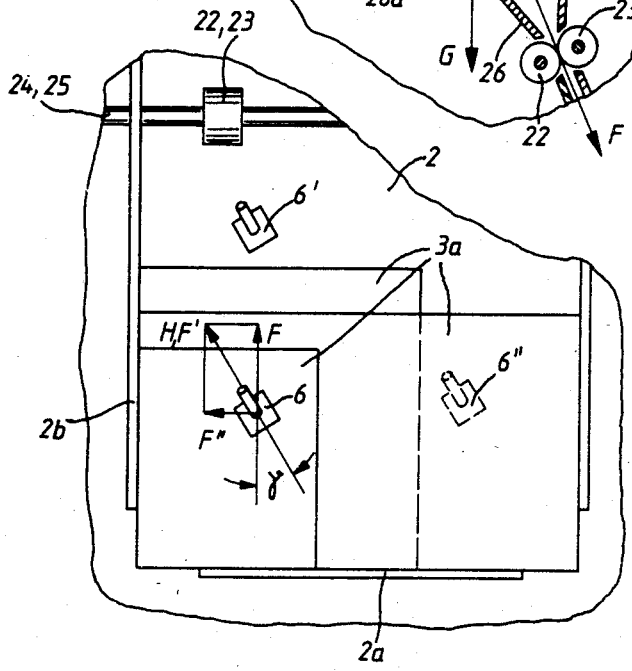
FIG. 13 is a view showing the inventive arrangement in accordance with still a further embodiment of the invention.

In accordance with FIG. 13, sheets 3a of different formats lie on a stack table 2. The suction mouthpiece 6 is placed so that it can engage alternately each sheet format 3a placed on a rear stack stop 2a and a lateral stack stop 2b. Its transporting direction F' is turned relative to the transporting direction F by such an angle $\alpha$, that a transporting component F'' is produced on the lateral guide 2b. The transported sheet, regardless of its outer dimensions, abuts during the entire transporting process against the lateral guide 2b and supplied without tilting to the transporting rollers 22 and 23.

As can also be seen from FIG. 13, a further suction mouthpiece 6' can be arranged additionally to the mouthpiece 6 for bridging a long transport path to the first transporting roller pair 22 and 23. Moreover, it is possible for transportation of wider formats to provide several suction mouthpieces, for example such as the mouthpieces 6, 6' and 6'' arranged one behind the other.

Figure 14:
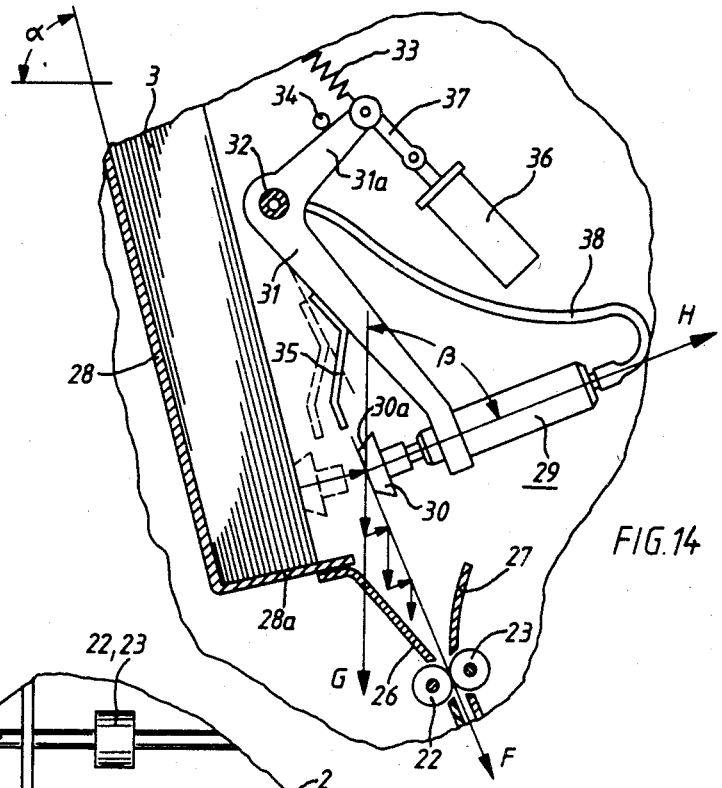
FIG. 14 is a view showing a suction mouthpiece for removal of large-format or different-format sheets.

FIG. 14 shows the inventive separating arrangement in accordance with an embodiment in which a stack table 28 is inclined in the transporting direction by an angle $\alpha$ relative to the horizontal plane. A stack stop 28a is arranged in this case prior to the sheet stack 3. A suction remover 29 with a suction mouthpiece 30 is mounted on a turnable carrier 31 which is supported on a stationary axle 32. The carrier 31 is arranged under the action of a pulling spring 32 which tries to turn it in counterclockwise direction and thereby abuts the same against a stationary stop 34. Because of this turning movement, the suction mouthpiece 30 is lifted in the immovable condition from the upper surface of the stack. During this operational phase it is possible to complete the stack 3 by further sheets. A guiding plate 36 arranged on the carrier 31 prevents blocking of the displaced sheets behind the suction mouthpiece 30. Additionally, the part of the suction mouthpiece 30 which projects in the immovable condition over the guiding plate 35 is provided with an insertion incline 30*a*.

The turning movement of the carrier 31 serves for increasing the initial lifting movement of the suction mouthpiece. As long as this great initial stroke is not necessary, $H_{min}$ of FIG. 12 can be selected correspondingly smaller, whereby a greater freedom for the selection of the above mentioned values influencing the stroke of the suction mouthpiece take place.

For performing the adjusting movement, a lifting magnet 36 is provided, which is connected by a pulling rod 37 with one arm 31*a* of the movable carrier 31. The lifting magnet 36 is actuated by a suitable control means shortly before the switching-on of the pulsating suction remover 29, 30, and switched off shortly after switching-on of the suction remover. A connecting conduit 38 to the suction remover 29, 30 arranged on the turnable carrier 31 is guided in a known manner through a hollow turning axle 32.

The inclination $\beta$ of the lifting direction H relative to the direction of the force of gravity G is selected in this case so that the lifting movement together with the tilting movement of the carrier 31 substantially separates only the separated sheet from the stack and lifts it over the front stop 28*a* of the stack, whereas the movement component of the separated sheet 3*a* acting in the transporting direction F is mainly derived from the falling movement in the direction of the force of gravity G. With the aid of this transporting movement, the sheet is supplied to the transporting roller pair 22, 23 arranged in a guide path formed by guiding plates 26 and 27.

Figure 15:
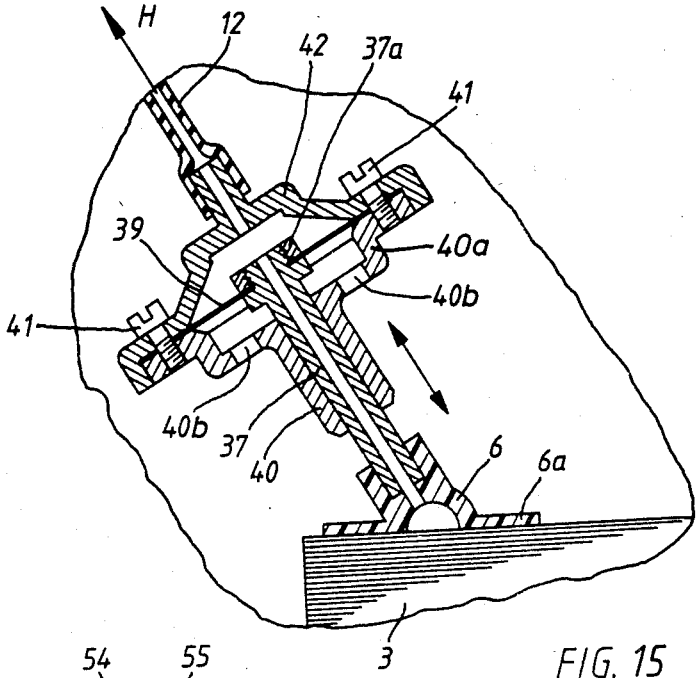
FIG. 15 is a view showing a movable suction mouthpiece which is connected with a diaphragm.

A diaphragm 39 is mounted at the upper end of the tubular piston 37, which carries the movable suction mouthpiece 6, with the aid of a ring nut 37*a* as shown in FIG. 15. The diaphragm 39 is arranged in an upper 40*a* of a cylinder guide 40, the part having a cross section increased in a container-like manner. The diaphragm 39 is covered by a cap 42 mounted on the cylinder guide 4 by screws 41. The suction air conduit 12 is connected with the cap 42. A chamber enclosed between the diaphragm 39 and the cap 42 is connected with a valveless pump, whereas a chamber located under the diaphragm is connected by the ventilating openings 40*b* with the outer air.

In this embodiment the pump pressure acts on a considerably greater surface than the cross-sectional surface of the piston 37, so that the negative pressure required for the suction mouthpiece 6 acts in a considerably stronger manner upon the movement of the piston 37. As mentioned above, the movement characteristic shown in FIG. 12 can thereby be influenced in such a sense that the air pressure produced in the conduit 12 acts in a stronger manner upon the movement of the suction mouthpiece.

Figure 16:
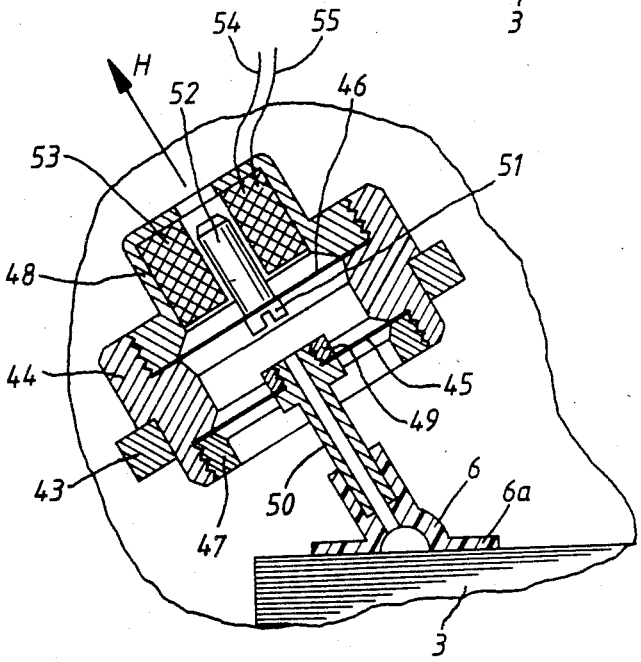
FIG. 16 is a view showing a suction remover united with a membrane pump in a separate structural unit.

In FIG. 16 a ring body 44 is arranged in a holder 43 fixedly connected with the arrangement, and two diaphragms 45 and 46 are provided in the ring body 44. The lower membrane 45 is held by a threaded ring 47, whereas the upper diaphragm 46 is held by a threaded cap 48 in the ring body 44. A tubular carrier 50 for the movable suction mouthpiece 6 is mounted on the diaphragm 45 by a ring nut 49. The diaphragm 46 is connected by a screw 51 with a pin-shaped magnet armature 52 inserted in a magnet spool 43 which is arranged in the threaded cap 48. The magnet spool 53 is connected by conductors 54 and 55 with a not shown generator of alternating current. The latter supplies alternating current of the frequency required for the operation of the suction remover in a cycle required for the separation and transport of the sheets located in the stack 3. The diaphragm 46 forms a diaphragm pump required in this case for the operation of the movable suction mouthpiece 6. The thus formed diaphragm pump, together with the suction remover, is insertable as a unit into the arrangement and removable from the latter for maintenance. Naturally, the tubular carrier 50 for the movable suction mouthpiece 6 can also be guided in a cylinder guide in a manner shown in FIG. 15.

It will be understood that each of the elements described above, or two or more together, may also find a useful application in other types of constructions differing from the types described above.

While the invention has been illustrated and described as embodied in an arrangement for separating and transporting respective uppermost sheets of a stack of sheets or sheet-like objects, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, form the standpoint of prior art, fairly constitute essential characteristics of the generic or specific aspects of this invention.

What is claimed as new and desired to be protected by Letters Patent is set forth in the appended claims:

1. An arrangement for separating and transporting uppermost sheets of a stack of sheets, comprising a suction mouthpiece to which a suction is applied for adhering an uppermost sheet thereto; a valveless pump connected with said mouthpiece by a connecting conduit and operable to generate a plurality of alternating pulsating positive and negative pressure phases; and a guide provided for guiding said suction mouthpiece in a predetermined direction, said pump imparting to said suction mouthpiece a lifting movement to lift said uppermost sheet from the stack by suction and also a pulsating movement according to said positive and negative pressure phases to shake off double sheets unintentionally pulled during the lifting movement of said suction mouthpiece and further to transport said sheet away from the stack, said guide maintaining said suction mouthpiece during said movement at an angle $\beta < 90°$ to an upper surface of the stack.

2. An arrangement as defined in claim 1, wherein said guide includes a guide cylinder connected with said valveless pump, and a piston having a central opening and guided in said guide cylinder, said suction mouthpiece being mounted on said piston.

3. An arrangement as defined in claim 2; and further comprising a pressing spring engaging with said piston and arranged to place said mouthpiece against the sheet.

4. An arrangement as defined in claim 1; and further comprising a drive for said movable suction mouthpiece and including a diaphragm located in said connecting conduit to said valveless pump.

5. An arrangement as defined in claim 4, wherein said movable suction mouthpiece is mounted directly on said diaphragm.

6. An arrangement as defined in claim 1, wherein said valveless pump is formed as a diaphragm pump.

7. An arrangement as defined in claim 6; and further comprising a magnetically driven diaphragm pump arranged on said guide for said movable suction mouthpiece.

8. An arrangement as defined in claim 1, wherein said suction mouthpiece has an end arranged to face toward a stack of sheets and formed as an elastic supporting plate.

9. An arrangement as defined in claim 1; and further comprising at least one further such suction mouthpiece arranged so that said suction mouthpieces serve for engaging large formats or different format sheets.

10. An arrangement as defined in claim 9, wherein said suction mouthpieces are arranged near one another as considered in said transporting direction.

11. An arrangement as defined in claim 9, wherein said suction mouthpieces are arranged one behind the other as considered in said transport direction.

12. An arrangement as defined in claim 9, wherein the sheet is transported in said transporting direction in a transport path; and further comprising a stop arranged laterally of said transport path, at least one of said mouthpieces being turned relative to the intended transporting direction by such an angle that in addition to the movement component in said transporting direction, another movement component directed against said lateral stop is produced.

13. An arrangement as defined in claim 1; wherein said suction mouthpiece has a ventilating conduit; and further comprising a valve arranged in said ventilating conduit of said mouthpiece and controlling the phases of said movable mouthpiece.

14. An arrangement as defined in claim 1; and further comprising an adjusting device provided for said movable suction mouthpiece.

15. An arrangement as defined in claim 14; and further comprising an electromagnet arranged to drive said adjusting device for said movable suction mouthpiece.

16. An arrangement as defined in claim 1; and further comprising a rising table arranged for controlling a level of the sheets in the sheet stack.

17. An arrangement as defined in claim 1; and further comprising a stack table for supporting the stack of sheets, said stack table being inclined opposite to the transporting direction and having a rear end provided with a stack stop.

18. An arrangement as defined in claim 1; and further comprising a stack table arranged to support the sheet stack, said stack table being inclined in said transporting direction and having a front end provided with a stack stop.

* * * * *